US006617533B1

(12) United States Patent
Lawson et al.

(10) Patent No.: US 6,617,533 B1
(45) Date of Patent: Sep. 9, 2003

(54) INTERLOCK FOR A CIRCUIT BREAKER

(75) Inventors: Robert P. Lawson, Snellville, GA (US); Andrew Hall, Lilburn, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 10/251,386

(22) Filed: Sep. 20, 2002

(51) Int. Cl.[7] ..... H01H 9/26

(52) U.S. Cl. ..... 200/50.32; 200/50.33; 200/50.37; 361/161

(58) Field of Search ..... 200/50.33, 50.32, 200/50.31, 50.37, 50.39, 50.01, 17 R, 18; 335/159–162

(56) References Cited

U.S. PATENT DOCUMENTS

| | | | | | |
|---|---|---|---|---|---|
| 5,008,499 | A | * | 4/1991 | Yee et al. | 200/50 C |
| 5,239,144 | A | | 8/1993 | Robbins et al. | 200/50 R |
| 5,508,670 | A | | 4/1996 | Mantzouridis et al. | 335/172 |
| 5,725,085 | A | * | 3/1998 | Seymour et al. | 200/50.33 |
| 5,814,777 | A | * | 9/1998 | Green et al. | 200/50.33 |
| 5,831,503 | A | | 11/1998 | Beck et al. | 335/172 |
| 5,874,698 | A | * | 2/1999 | Collis | 200/50.33 |
| 5,875,088 | A | | 2/1999 | Matsko et al. | 361/96 |
| 5,955,716 | A | | 9/1999 | Thuries et al. | 218/154 |
| 6,031,193 | A | | 2/2000 | Flegel | 200/50.33 |
| 6,043,439 | A | * | 3/2000 | Crooks et al. | 200/50.33 |
| 6,066,814 | A | | 5/2000 | Smith et al. | 200/50.24 |
| 6,069,328 | A | | 5/2000 | Oravetz et al. | 200/50.33 |
| 6,184,595 | B1 | | 2/2001 | Flegel | 307/114 |
| 6,284,989 | B1 | | 9/2001 | Bernier et al. | 200/50.12 |
| 6,388,214 | B1 | * | 5/2002 | Jones et al. | 200/50.33 |
| 6,400,245 | B1 | | 6/2002 | Castonguay et al. | 335/202 |

* cited by examiner

*Primary Examiner*—Lincoln Donovan
*Assistant Examiner*—K. Lee
(74) *Attorney, Agent, or Firm*—Foley & Lardner

(57) ABSTRACT

An interlock for two circuit breakers, with the circuit breakers configured in the same electrical circuit and with each circuit breaker having a cross bar and contact assembly. The interlock comprises a pivot pin mounted a spaced distance from the two circuit breakers. An interlock yoke having two ends, with a notch proximate each end of the yoke and the yoke is coupled to the pivot pin. A first operator rod having a first end is configured to engage the cross bar and contact assembly of one circuit breaker and has a second end configured to engage the notch of the yoke. A second operator rod having a first end is configured to engage the cross bar and contact assembly of the other circuit breaker and has a second end configured to engage the notch of the yoke. When one operator rod is moved by the cross bar and contact assembly of one circuit breaker, that operator rod pivots the yoke, causing the other operator rod to block the operation of the other circuit breaker.

20 Claims, 5 Drawing Sheets

INTERLOCK FOR A CIRCUIT BREAKER

BACKGROUND OF THE INVENTION

The present invention relates generally to the field of electrical circuit breakers, and more particularly to an interlock for at least two circuit breakers.

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are several ways by which the operating mechanism for the circuit breaker can disengage the operating contacts:

the circuit breaker operating handle can be used to activate the operating mechanism; or a tripping mechanism, responsive to unacceptable levels of current carried by the circuit breaker, can be used to activate the operating mechanism; or auxiliary devices can be used to trip the circuit breaker thereby move the movable contact. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact(s) engage the stationary contact(s). A motor coupled to the circuit breaker operating handle can also be used to engage or disengage the operating contacts. The motor can be remotely operated.

A typical industrial circuit breaker will have a continuous current rating ranging from as low as 15 amps to as high as several thousand amps. The tripping mechanism for the breaker usually consists of a thermal overload release and a magnetic short circuit release. The thermal overload release operates by means of a bimetallic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as for the period of time that that current is flowing. For a given range of current ratings, the bi-metal cross-section and related elements are specifically selected for such current range resulting in a number of different circuit breakers for each current range. The tripping mechanism may be housed in the same housing as the operating mechanism and contacts or it may be housed in a separate housing coupled to the housing containing the operating mechanism and contacts.

In many instances, several circuit breakers are used to control an electrical system. Often more than one circuit breaker is provided in order that one breaker will be operating while another is being serviced or replaced. Multiple circuit breakers are used typically to allow multiple power sources to be available for use as inputs to an electrical system without the hazard of both systems energized on the electrical system simultaneously. A common application of this type of arrangement is used as a transfer switch. The transfer switch controls the input power to an electrical system from the main power lines and a back-up power source such as a generator. The switch controls whether one of the power line or generator is connected to the electrical system to provide the input power. In such case, a separate circuit breaker would be used in each of the power source input lines. However, an operator would want only one circuit breaker operable in the overall system. Although some mechanical interlocking devices have been disclosed in the past for other types of circuit breakers, such interlock devices are designed to be used with specific circuit breakers or are installed in the circuit breaker housing, or require additional and complex circuitry to operate the interlock such as using an electrically energized relay.

Thus, there is a need for an interlock for circuit breakers that does not require additional circuitry or mechanisms to operate. There is a need for an interlock for circuit breakers which allows only one circuit breaker at a time to be energized. There is also a need for an interlock which the driving force to operate the interlock is provided by the circuit breakers themselves but also provides a neutral position when both circuit breakers are in the "off" position.

SUMMARY OF THE INVENTION

The present invention provides a method for preventing two circuit breakers from operating in the same electrical circuit, with each circuit breaker having a cross bar and contact assembly. The method comprises the steps of providing a first operator rod configured to engage the cross bar and contact assembly of one circuit breaker. Providing a second operator rod configured to engage the cross bar and contact assembly of the other circuit breaker. Providing an interlock yoke having two ends, with a notch proximate each end of the yoke. Mounting the yoke a spaced distance from the two circuit breakers. Pivoting the yoke a distance between the two circuit breakers and aligning each notch with one of the first and second operator rods. When one operator rod is moved by the cross bar and contact assembly of one circuit breaker, that operator rod pivots the yoke causing the other operator rod to block the operation of the other circuit breaker. Another embodiment of the method provides that the yoke is mounted on a structure apart from a circuit breaker supporting structure.

There is also provided an interlock for two circuit breakers, with the circuit breakers configured in the same electrical circuit and with each circuit breaker having a cross bar and contact assembly. The interlock comprises a pivot pin mounted a spaced distance from the two circuit breakers. An interlock yoke having two ends, with a notch proximate each end of the yoke and the yoke is coupled to the pivot pin. A first operator rod having a first end is configured to engage the cross bar and contact assembly of one circuit breaker and has a second end configured to engage the notch of the yoke. A second operator rod having a first end is configured to engage the cross bar and contact assembly of the other circuit breaker and has a second end configured to engage the notch of the yoke. When one operator rod is moved by the cross bar and contact assembly of one circuit breaker, that operator rod pivots the yoke, causing the other operator rod to block the operation of the other circuit breaker. Another embodiment of the interlock includes a locator member configured to align the operator rod with the cross bar and contact assembly of each respective circuit breaker. The locator member can also include a biasing member.

There is further provided an interlock for two circuit breakers with the circuit breakers configured in the same electrical circuit and with each circuit breaker having a cross bar and contact assembly. The interlock comprises a means for pivoting mounted a spaced distance from the two circuit breakers. A means for pushing having two ends, with a means for engaging proximate each end of the means for pushing and the means for pushing coupled to the means for pivoting. A first means for transmitting force having a first end configured to engage the cross bar and contact assembly of one circuit breaker and a second end configured to engage the means for engaging the means for pushing. A second means for transmitting force having a first end configured to engage the cross bar and contact assembly of the other circuit breaker and the second end configured to engage the means for engaging the means for pushing. When one means for transmitting force is moved by the cross bar and contact assembly of one circuit breaker that means for transmitting force pivots the means for pushing causing the other means for transmitting force to block the operation of the circuit breaker.

DETAILED DESCRIPTION OF THE EXEMPLARY EMBODIMENTS

Figure 1:
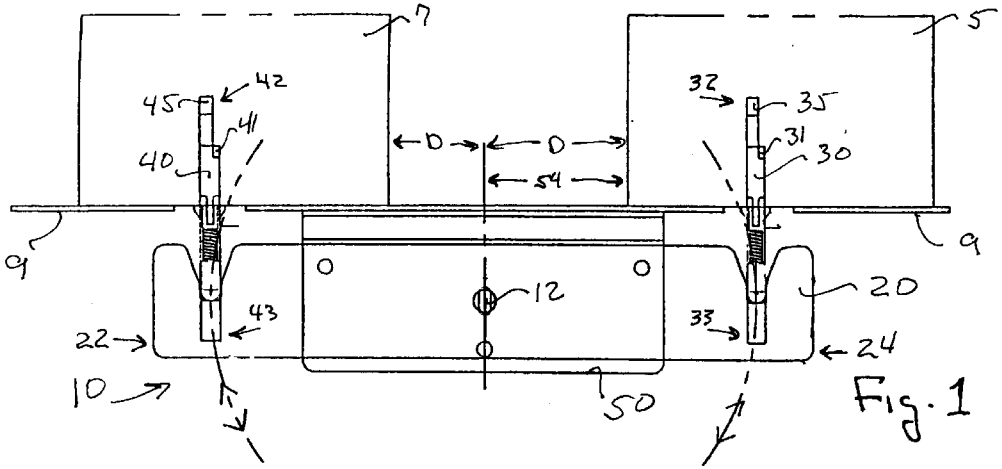
FIG. 1 is a plan view of an exemplary embodiment of an interlock for two circuit breakers, with the circuit breakers mounted in a horizontal plane and illustrating the interlock in a neutral position and each circuit breaker in an "OFF" position.
Figure 2:
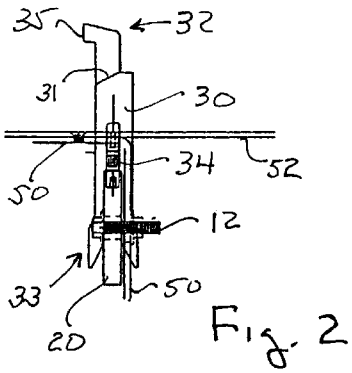
FIG. 2 is a partial plan view of an exemplary embodiment of an operator rod engaged with a notch of an interlock yoke and illustrating the pivot pin coupling interlock yoke to a mounting plate.

A three phase molded case circuit breaker typically includes an operating mechanism having a pivoting member with a handle. The pivoting member and handle are moveable between an "ON" position, an "OFF" position, and a "TRIPPED" position. A typical industrial circuit breaker is a three pole breaker having three sets of contacts for interrupting current in each of the three respective electrical transmission phases. The center pole circuit breaker includes an operating mechanism which controls the switching of all three poles of the breaker. Although an embodiment of a circuit breaker is described in the context of the three phase circuit breaker, it is contemplated that it may be practiced in a single phase circuit breaker or in other multi-phase circuit breakers.

There is illustrated exemplary embodiments of a molded case circuit breakers that are operable between the "ON" and "OFF" positions to enable a contact operating mechanism to engage and disengage a moveable contact and a stationary contact for each of the three phases, such that the line terminal and load terminal of each phase can be electrically connected. A portion of the operating mechanism is shown in FIGS. 4–7 and is referred to as a crossbar and contact assembly 6. The crossbar and contact assembly 6 will be described further below. The circuit breaker housing includes three portions which are molded from an insulating material. These portions typically include a circuit breaker base, a circuit breaker cover and an accessory cover with breaker cover and the accessory cover having an opening for the handle of the pivoting member. The pivoting member and handle move within the opening during the several operations of the circuit breaker. The main components of the circuit breaker are a fixed line contact arm and a moveable load contact arm. The load contact arms for each of the three phases of the exemplary breaker are mechanically connected together by an insulating cross bar member. A portion of this assembly is shown as the crossbar and contact assembly 6 illustrated in FIGS. 4–7. This cross bar member, in turn, is mechanically coupled to the operating mechanism so that, by moving the handle the cross bar rotates in a clockwise direction and all three load contact arms are concurrently moved to engage their corresponding line contact arms, thereby making electrical contact between moveable contact pad and stationary contact pad.

The operating mechanism includes a cradle which engages a latch mechanism to hold the contacts of the circuit breaker in a closed position unless and until an over current condition occurs, which causes the circuit breaker to trip, or the latch is acted upon by a latch shaft assembly as a result of a condition to be described below.

A portion of the moveable contact arm and the stationary contact bus are contained in an arc chamber. Each pole of the circuit breaker is typically provided with an arc chamber which is molded from an insulating material and is part of the circuit breaker housing. A plurality of arc plates is maintained in the arc chamber. The arc plates facilitate the extension and cooling of the arc formed when the circuit breaker is opened while under a load and drawing current. The arc chamber and arc plates direct the arc away from the operating mechanism.

During normal operation of the circuit breaker, current flows from the line terminal through the line contact arm and its stationary contact pad to the load contact arm through its contact pad. From the load contact arm, the current flows through a connector, for example a flexible braid, to the bimetallic element and from the bimetallic element to the load terminal. When the current flowing through the circuit breaker exceeds the rated current for the breaker, it heats the bimetallic element, causing the element to bend towards a trip bar. If the over current condition persists, the bimetallic element bends sufficiently to engage the trip bar surface. As the bimetallic element engages the trip bar surface and continues to bend, it causes the trip bar to rotate and thus unlatching the operating mechanism of the circuit breaker. The trip can all be produced by an electronic trip mechanism that will trip the breaker when an overload condition is sensed.

The breaker cover, can have two accessory pockets formed in the cover, with one accessory pocket on either side of the opening for the pivoting member and handle. The breaker cover with the accessory pockets or compartments can be formed, usually by well known molding techniques, as an integral unit. The accessory pocket can also be fabricated separately and attached to the breaker cover by any suitable method such as with fasteners or adhesives. The breaker cover is sized to cover the operating mechanism, the moveable contact and the stationary contact, as well as the trip mechanism of the circuit breaker. The breaker cover has an opening to accommodate the handle.

Each accessory pocket or compartment is provided with a plurality of openings. The accessory pocket openings are positioned in the pocket to facilitate coupling of an accessory with the operating mechanism mounted in the housing. The accessory pocket openings also facilitate simultaneous coupling of an accessory with different parts of the operating mechanism and the latch shaft assembly. Various devices or accessories associated with the circuit breaker can be mounted in the accessory compartment to perform various functions. Some accessories, such as a shunt trip, will trip the circuit breaker, upon receiving a remote signal, by pushing the latch shaft assembly, causing release of the latch mechanism of the operating mechanism. The shunt trip has a member protruding through one of the openings in the accessory pocket and engages the operating mechanism, via the latch shaft assembly. Another accessory, such as an auxiliary switch, provides a signal indicating the status of the circuit breaker, e.g. "ON" or "OFF". When the auxiliary switch is nested in the accessory pocket, a member on the switch assembly protrudes through one of the openings in the pocket and is in engagement with the operating mechanism, typically the cross bar. Multiple switches can be nested in one accessory pocket and each switch can engage the operating mechanism through a different opening in the pocket.

The interlock 10 is used in conjunction with two circuit breakers 5 and 7 to allow multiple power sources to be available for use as inputs to an electrical system. The interlock 10 prevents both power sources from being energized in the electrical system simultaneously. The interlock 10, also referred to as a walking beam interlock, allows only one circuit breaker 7, for example, at a time to be energized (See FIG. 3). A common application of this interlock 10 and a multi-power source system would be in a device called a transfer switch. This type of device controls the input power to an electrical system for the main power lines and from a backup power source such as, for example, a generator.

The interlock 10 allows only one circuit breaker to be closed at any one instant in time. If one circuit breaker 7 is closed, i.e., "ON", the other circuit breaker, 5 would be blocked from operation. If the first circuit breaker 7 was opened, i.e., "OFF", the other circuit breaker 5 would then be available and could be closed. In that instance, the first circuit breaker 7 would be blocked from closing. In the event that an operator would attempt to close both circuit breakers 5 and 7 simultaneously, either circuit breaker 5 or 7 would close but the other would not be allowed to close because of the interlock 10.

For the interlock 10 to function properly, the two circuit breakers 5 and 7 must be rigidly mounted in an enclosure 9 or to a surface 52 with the interlock 10 also rigidly mounted. See FIGS. 1 and 3.

Figure 3:
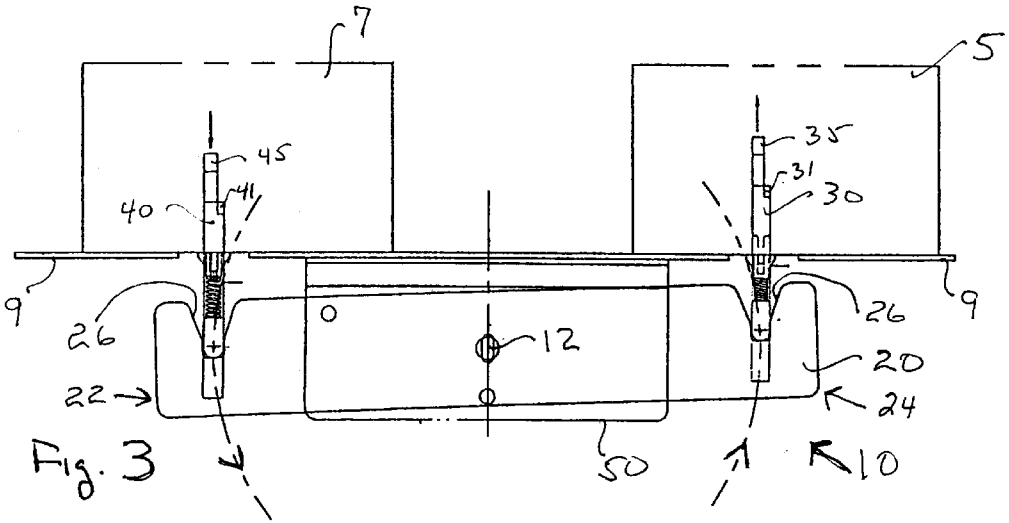
FIG. 3 is a plan view of an exemplary embodiment of an interlock for two circuit breakers illustrating the relative motion of the yoke and each operating rod with respect to the two circuit breakers, with one circuit breaker "ON" and the other circuit breaker blocked.

The interlock 10 for two circuit breakers 5 and 7, with the circuit breakers 5 and 7 configured in the same electrical circuit and with each circuit breaker having a cross-bar and contact assembly 6. The cross-bar and contact assembly includes a cam 4. The interlock 10 comprises a pivot pin 12 mounted a spaced distance d from the two circuit breakers 5 and 7. An interlock yoke 20 having two ends, 22, 24, with a notch 26 proximate each end of the yoke 20 and the yoke 20 coupled to the pivot pin 12. A first operator rod having a first end 32 is configured to engage the cross-bar and contact assembly 6 of one circuit breaker 5 and a second end 33 is configured to engage the notch 26 of the yoke 20 at the end 24 of the yoke. A second operator rod 40 having a first end 42 and a second end 43 is configured to engage the cross-bar and contact assembly 6 of the other circuit breaker 7 and a second end 43 of the operator rod 40 is configured to engage the notch 26 of the yoke 20. When one operator rod 40 is moved by the cross-bar and contact assembly 6 of one circuit breaker 7, that operator rod 40 pivots the yoke 20 causing the other operator rod 30 to block the operation of the other circuit breaker 5. Such pivot operation is illustrated in FIG. 3.

The interlock 10 can include the mounting plate 50 supporting the pivot pin 12. The mounting plate 50 can be mounted on a structure 52 apart from the circuit breaker supporting the structure 9.

The interlock yoke 20 can be composed of metal or an engineered plastic having sufficient strength and durability for the selected application. The notch 26 at each end 22, 24 of the interlock yoke 20 can be configured as one of a V-shape and U-shaped as selected by the user of the interlock 10. Such configuration allows easy installation or removal of the circuit breaker since the operator rods are not fastened to the yoke. Likewise, the mounting plate 50 can be composed of any suitable and compatible material, such as metal or engineered plastic as selected by the designer of the system.

Each operator rod 30, 40 includes a locator member 34 configured to align the operator rod 30, 40 with the cross-bar and contact assembly 6 of each respective circuit breaker 5 and 7. (See FIGS. 2, 4–7) The operator rod 30, 40 can be composed of non-conductive material, such as for example an engineering grade plastic of suitable strength and durability for a selected application. The operator rod can be molded or machined.

The interlock 10 can be mounted in a horizontal plane 54 or in a vertical plane in relation to the mounting of the two circuit breakers 5 and 7. FIGS. 1 and 3 illustrate the horizontal plane mounting and it should be understood that the vertical plane mounting would be 90 degrees from the plane depicted in FIGS. 1 and 3.

The operator rods 30 and 40 of the interlock 10 are installed in their respective circuit breakers 5 and 7 through an interlock orifice 8 typically located in the back or lower portion of the circuit breaker. The operating rods 30, 40 are configured to be installed in only one manner thereby facilitating the assembly of the interlock 10 in the field. Each operator rod is provided with a locator member 34 which is biased by a biasing member 36 such as a compression spring, as best seen in FIGS. 2, 4–7. The operator rod locator member 34 allows adjustment of the mounting bracket 50 to allow installation to the proper operating position, such as a neutral position as seen in FIG. 1, of the interlock 10 in relation to the circuit breakers 5 and 7.

Figure 4:
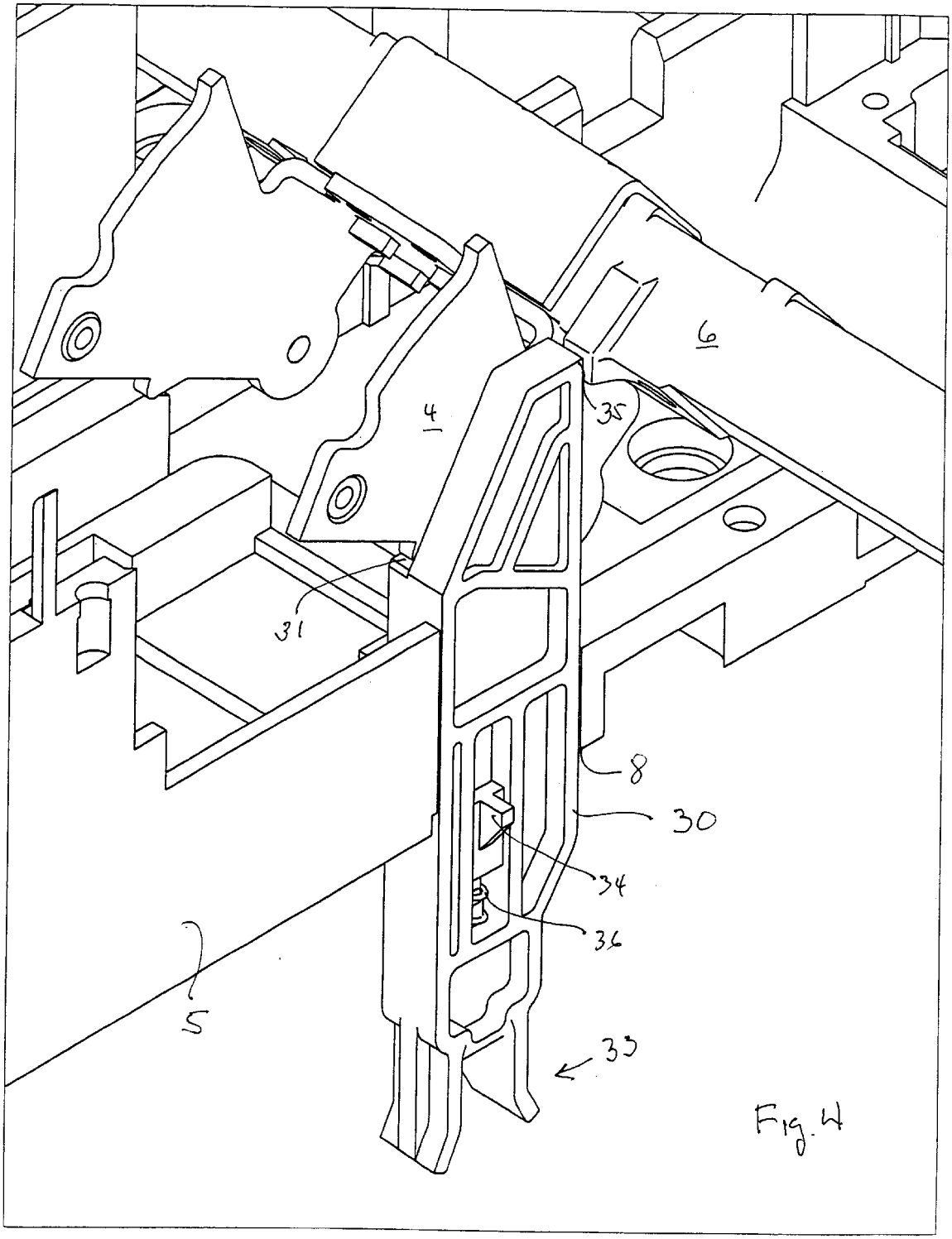
FIG. 4 is a partial perspective view of an exemplary embodiment of one side of an operating rod with the crossbar and contact assembly of a circuit breaker that is being blocked so that it remains in the "OFF" position.
Figure 5:
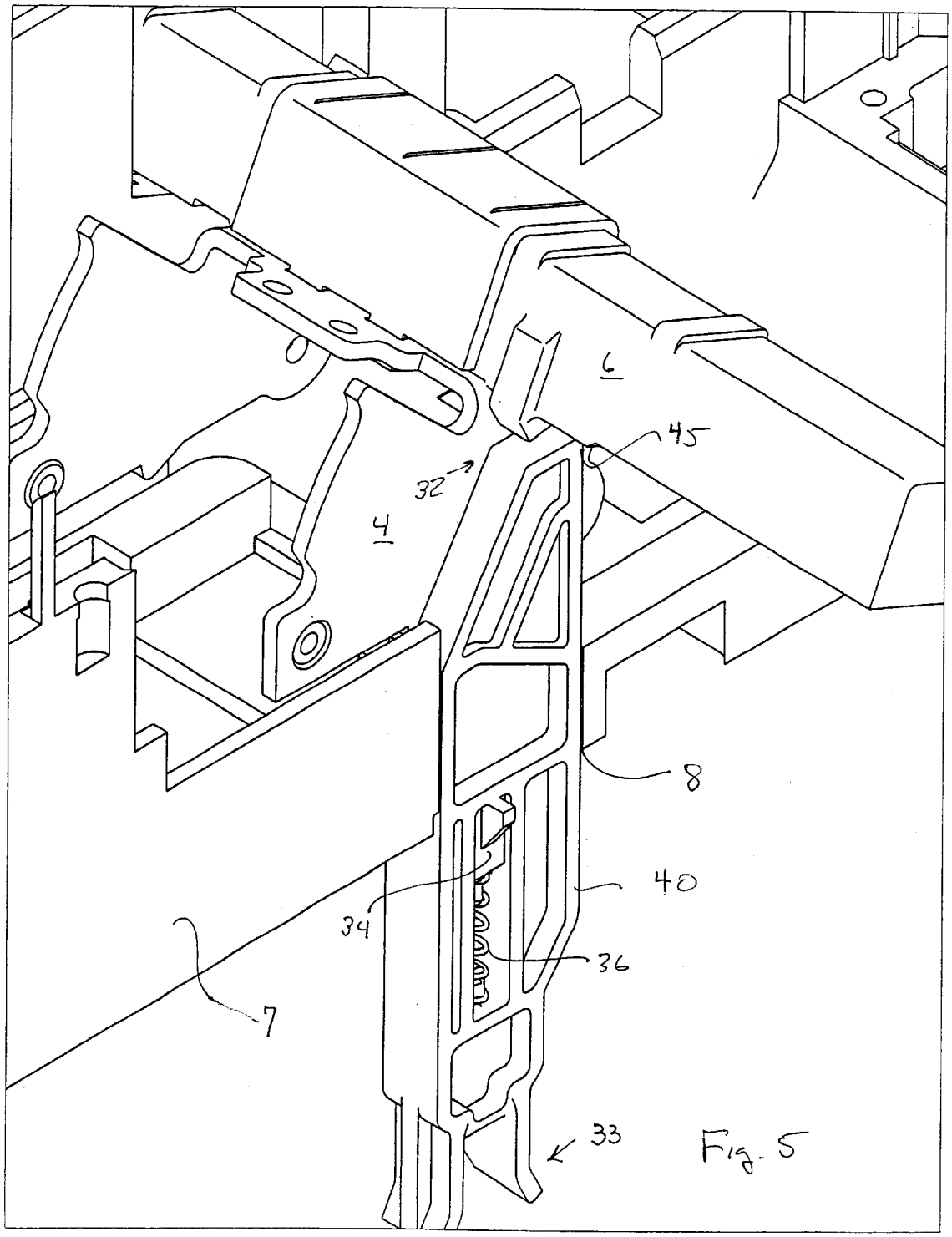
FIG. 5 is a partial perspective view of an exemplary embodiment of one side of an operating rod with the crossbar and contact assembly of a circuit breaker in the "ON" position.
Figure 6:
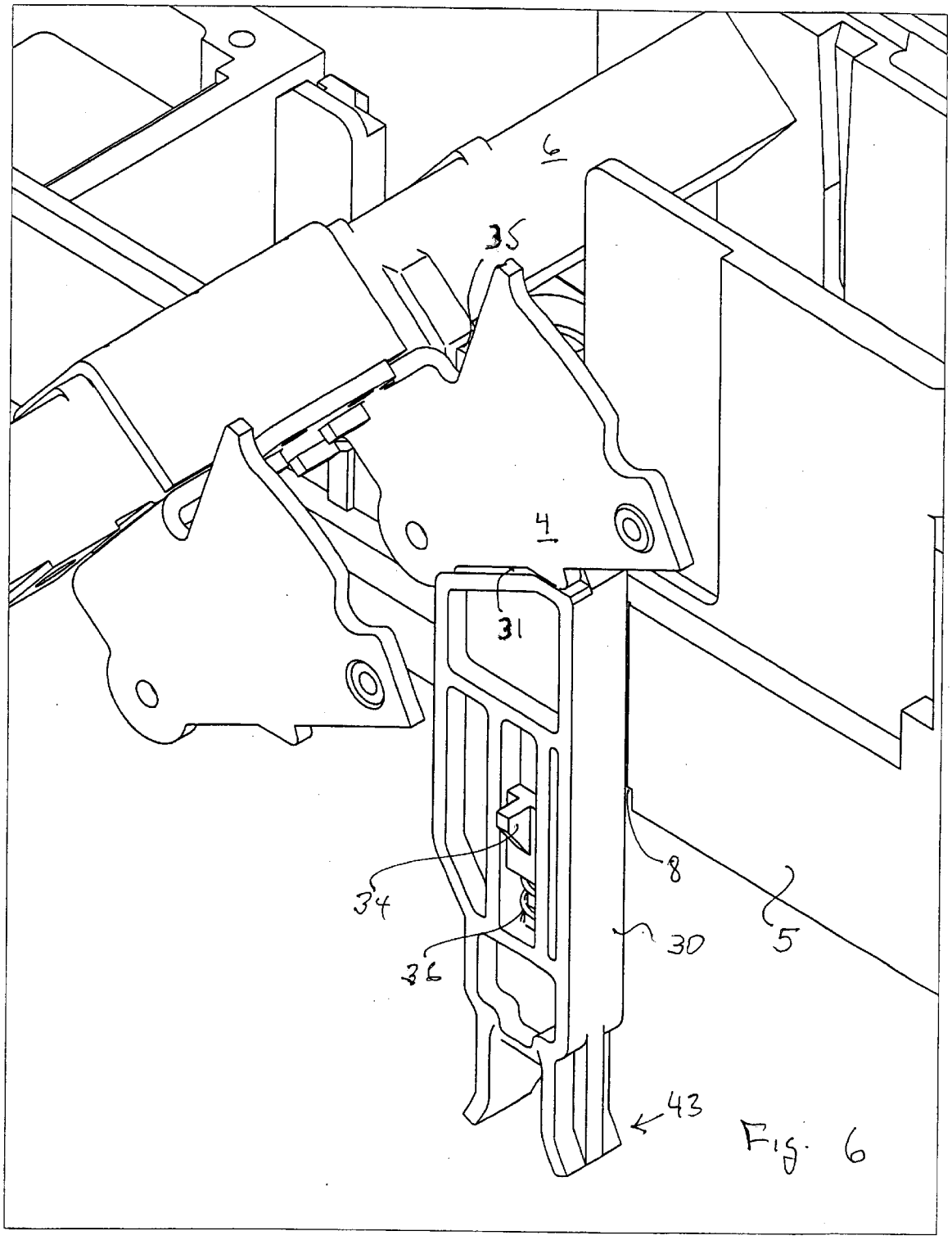
FIG. 6 is a partial perspective view of an exemplary embodiment of another side of the operating rod illustrated in FIG. 4 with the crossbar and contact assembly of the circuit breaker in the "OFF" position.
Figure 7:
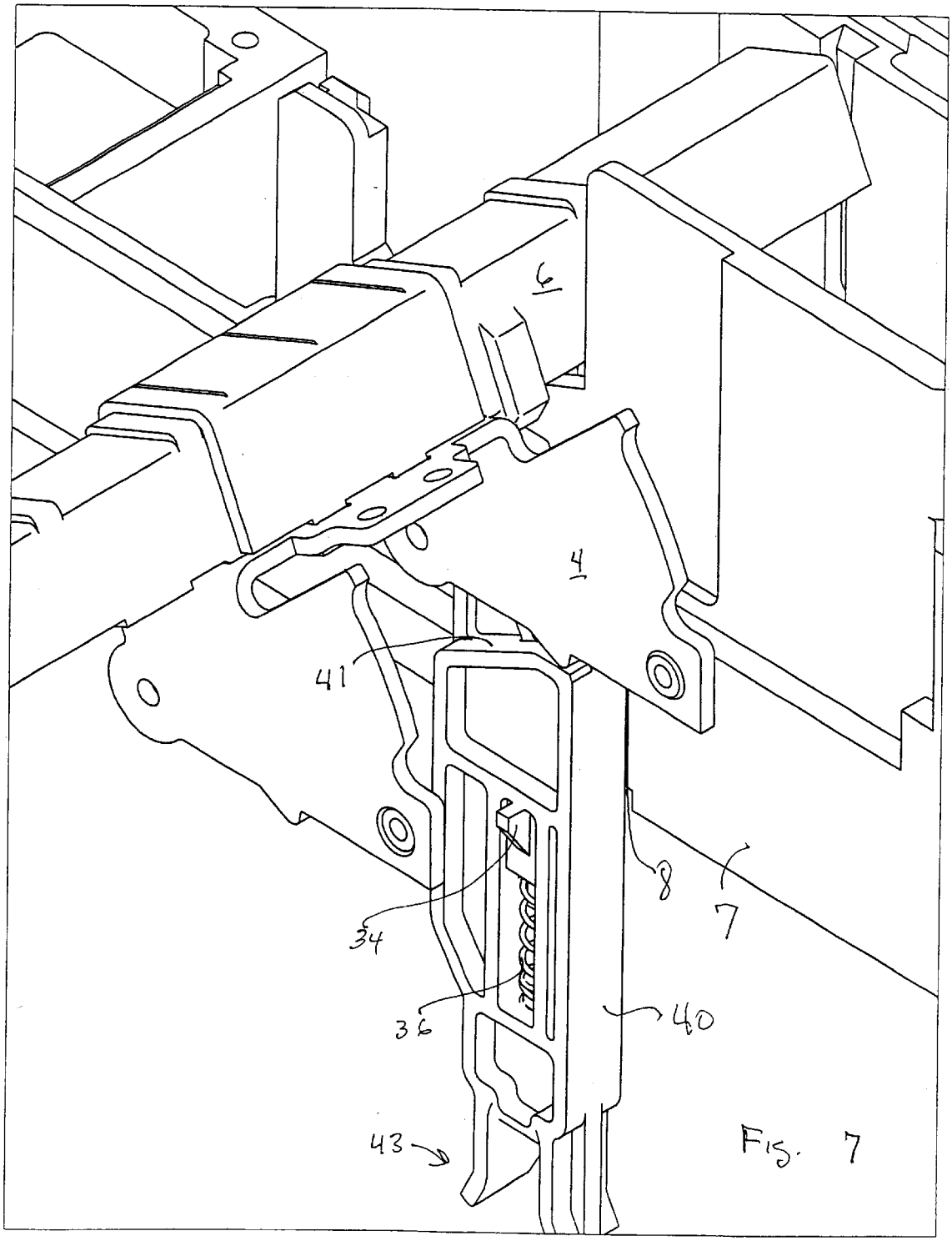
FIG. 7 is a partial perspective view of an exemplary embodiment of another side of the operating rod illustrated in FIG. 5 with the crossbar and contact assembly of the circuit breaker in the "ON" position.

Once the interlock 10 is mounted, the operating yoke 20 is moved towards the circuit breakers until the locator member 34 is touching the surface of the circuit breaker having the interlock orifice 8. This insures that the operator rods 30, 40 are properly located in the neutral positions (See FIG. 1). A proper location of each operator rod 30 and 40 is established, during operation, when the operator rod cam surface 31, 41 are aligned with the crossbar cam 4 as best seen in FIGS. 6 and 7 and the crossbar locking cam surface of each operator rod 35, 45 are aligned with the cross-bar and contact assembly 6 as best seen in FIGS. 4 and 5.

In operation, the cam surfaces on the operator rod 30, 40 interface with the circuit breaker cross-bar and contact assembly 6 as described above. The crossbar locking cam surface 35, 45 of each respective operator rod 30, 40 stops the closure of the circuit breaker by being activated and pushed into location to stop the forward travel of the crossbar of one of the circuit breakers preventing electrical contact closure of that circuit breaker. See FIG. 4. It should be understood that because of the pivoting of the interlock yoke 20, one or the other circuit breaker will be blocked as the result of the operation of the interlock mechanism 10. When both circuit breakers 5 and 7 are in the "OFF" position, the biasing member 36 of each operator rod 30, 40 drives the locator member 34 to return the interlock yoke 20 to a neutral position, see FIG. 1, until one or the other circuit breakers 5 or 7 are operated.

It should be noted that the interlock 10 for the two circuit breakers 5, 7 operates independent of the handle position of the circuit breakers. The interlock 10 operation is dependent upon the position of the crossbar and contact assembly 6 within the operating mechanism of the circuit breakers 5, 7 as described above. Because of such operation, a motor operator or other accessory product that engages the handle of the circuit breaker will not affect the. proper operation of the interlock 10 since it is the position of the crossbar and contact structure assembly 6 of the circuit breaker that operates the interface 10. If the circuit breaker experiences an overload then the crossbar and contact assembly 6 is tripped by the tripping mechanism of the circuit breaker, the electrical contacts of the circuit breaker will open moving the crossbar and contact assembly 6 to operate the operator rod 30 or 40 of that respective circuit breaker which in turn will allow the interlock 10 to function as described above.

It should also be understood that there is provided a method of preventing two circuit breakers 5 and 7 from operating in the same electrical circuit with each circuit breaker 5, 7 having a crossbar and contact assembly 6. The method comprises the steps of providing a first operator rod 30 configured to engage the crossbar and contact assembly 6 of one circuit breaker 5. Providing a second operator rod 40 configured to engage the crossbar and contact assembly 6 of the other circuit breaker 7. Providing an interlock yoke 20 having two ends 22, 24 with a notch 26 proximate each end 22, 24 of the yoke 20. Mounting the yoke a spaced distance from the two circuit breakers 5 and 7 and pivoting the yoke 20 a distance between the two circuit breakers 5 and 7. Aligning each notch 26 with one of the first and second operator rods 30, 40. When one operator rod 40 is moved by the crossbar and contact assembly 6 of one circuit breaker 7 that operator rod pivots the yoke 20 causing the other operator rod 30 to block the operation of the other circuit breaker 5. The method can also include the step of mounting the yoke 20 in the same plane 54 as the two circuit breakers 5 and 7.

While the embodiments illustrated in the figures and described above are presently preferred, it should be understood that these embodiments are offered by way of example only. The invention is not intended to be limited to any particular embodiment but is intended to extend to various modifications that nevertheless fall within the scope of the appended claims. For example, it is also contemplated that the trip mechanism can have a bi-metal trip unit or an electronic trip unit with a load terminal being housed in a separate housing capable of mechanically and electrically connecting to another housing containing the operating mechanism and line terminal, thereby providing for a quick and easy change of current rating for an application of the circuit breakers contemplated herein. Modifications and variations will be evident to those with ordinary skill in the art.

What is claimed is:

1. A method of preventing two circuit breakers from operating in the same electrical circuit, with each circuit breaker having a crossbar and contact assembly, the method comprising the steps of:

providing a first operator rod configured to engage the crossbar and contact assembly of one circuit breaker;

providing a second operator rod configured to engage the crossbar and contact assembly of the other circuit breaker;

providing an interlock yoke having two ends, with a notch proximate each end of the yoke;

mounting the yoke a spaced distance from the two circuit breakers;

pivoting the yoke a distance between the two circuit breakers; and aligning each notch with one of the first and second operator rods, wherein, when one operator rod is moved by the crossbar and contact assembly of one circuit breaker, that operator rod pivots the yoke causing the other operator rod to block the operation of the other circuit breaker.

2. The method of claim 1, wherein the yoke is mounted on a structure apart from a circuit breaker supporting structure.

3. The method of claim 1, wherein the notch is one of a V-shape and U-shape.

4. The method of claim 1, wherein the step of mounting the yoke includes the step of mounting in the same plane as the two circuit breakers.

5. An interlock for two circuit breakers, with the circuit breakers configured in the same electrical circuit and with each circuit breaker having a crossbar and contact assembly, the interlock comprising:

a pivot pin mounted a spaced distance from the two circuit breakers;

an interlock yoke having two ends, with a notch proximate each end of the yoke and the yoke coupled to the pivot pin;

a first operator rod having a first end configured to engage the crossbar and contact assembly of one circuit breaker and a second end configured to engage the notch of the yoke; and a second operator rod a first end configured to engage the crossbar and contact assembly of the other circuit breaker and a second end configured to engage the notch of the yoke, wherein, when one operator rod is moved by the crossbar and contact assembly of one circuit breaker that operator rod pivots the yoke causing the other operator rod to block the operation of the other circuit breaker.

6. The interlock of claim 5, including a mounting plate supporting the pivot pin.

7. The interlock of claim 6, wherein the mounting plate is mounted on a structure apart from a circuit breaker supporting structure.

8. The interlock of claim 5, wherein each operator rod includes a locator member configured to align the operator rod with the crossbar and contact assembly of each respective circuit breaker.

9. The interlock of claim 8, wherein the locator member includes a biasing member.

10. The interlock of claim 5, wherein each notch is configured as one of a V-shape and U-shape.

11. The interlock of claim 6, wherein the interlock yoke is mounted in a horizontal plane with the two circuit breakers.

12. The interlock of claim 6, wherein the interlock yoke is mounted in a vertical plane with the two circuit breakers.

13. An interlock for two circuit breakers, with the circuit breakers configured in the same electrical circuit and with each circuit breaker having a crossbar and contact assembly, the interlock comprising:

a means for pivoting mounted a spaced distance from the two circuit breakers;

an means for pushing having two ends, with a means for engaging proximate each end of the means for pushing and the means for pushing coupled to the means for pivoting;

a first means for transmitting force having a first end configured to engage the crossbar and contact assembly of one circuit breaker and a second end configured to engage the means for engaging of the means for pushing; and a second means for transmitting force a first end configured to engage the crossbar and contact assembly of the other circuit breaker and a second end configured to engage the means for engaging of the means for pushing, wherein, when one means for transmitting force is moved by the crossbar and contact assembly of one circuit breaker that means for transmitting force pivots the means for pushing causing the other means for transmitting force to block the operation of the other circuit breaker.

14. The interlock of claim 13, including a means for mounting supporting the means for pivoting.

15. The interlock of claim 14, wherein the means for mounting is mounted on a structure apart from a circuit breaker supporting structure.

16. The interlock of claim 13, wherein each means for transmitting force includes a means for locating configured to align the means for transmitting force with the crossbar and contact assembly of each respective circuit breaker.

17. The interlock of claim 16, wherein the means for locating includes a means for biasing.

18. The interlock of claim 13, wherein each means for engaging is configured as one of a V-shape and U-shape.

19. The interlock of claim 14, wherein the means for pushing is mounted in a horizontal plane with the two circuit breakers.

20. The interlock of claim 14, wherein the means for pushing is mounted in a vertical plane with the two circuit breakers.

* * * * *